US011802324B2

(12) United States Patent
Kondoh

(10) Patent No.: US 11,802,324 B2
(45) Date of Patent: Oct. 31, 2023

(54) NITROGEN SOLID SOLUTION TITANIUM SINTERED COMPACT AND METHOD FOR PRODUCING SAME

(71) Applicant: HI-LEX CORPORATION, Hyogo (JP)

(72) Inventor: Katsuyoshi Kondoh, Osaka (JP)

(73) Assignee: HI-LEX CORPORATION, Hyogo (JP)

( * ) Notice: Subject to any disclaimer, the term of this patent is extended or adjusted under 35 U.S.C. 154(b) by 64 days.

(21) Appl. No.: 17/024,508

(22) Filed: Sep. 17, 2020

(65) Prior Publication Data

US 2021/0001405 A1 Jan. 7, 2021

Related U.S. Application Data

(62) Division of application No. 15/773,031, filed as application No. PCT/JP2016/081767 on Oct. 26, 2016, now Pat. No. 10,807,164.

(30) Foreign Application Priority Data

Nov. 2, 2015 (JP) ..... 2015-215847

(51) Int. Cl.

| | |
|---|---|
| ***C22C 14/00*** | (2006.01) |
| ***C22C 32/00*** | (2006.01) |
| ***C22C 1/053*** | (2023.01) |
| ***C22C 1/04*** | (2023.01) |
| ***B22F 1/145*** | (2022.01) |

(Continued)

(52) U.S. Cl.

CPC ..... *C22C 14/00* (2013.01); *B22F 1/145* (2022.01); *B22F 3/14* (2013.01); *B22F 3/24* (2013.01); *C22C 1/0458* (2013.01); *C22C 1/053* (2013.01); *C22C 32/0068* (2013.01); *B22F 1/147* (2022.01); *B22F 2003/248* (2013.01); *B22F 2301/205* (2013.01); *B22F 2302/20* (2013.01); *B22F 2998/10* (2013.01); *B22F 2999/00* (2013.01)

(58) Field of Classification Search

CPC ..... B22F 3/14

See application file for complete search history.

(56) References Cited

U.S. PATENT DOCUMENTS

2004/0251140 A1* 12/2004 Chung ..... H01G 9/042 205/50
2013/0149183 A1 6/2013 Araoka et al.
2017/0008087 A1* 1/2017 Kondoh ..... B22F 1/00

FOREIGN PATENT DOCUMENTS

EP 0687744 A2 * 12/1995
EP 1714942 A1 * 10/2006
JP S60224727 A 11/1985

(Continued)

OTHER PUBLICATIONS

International Search Report from corresponding International Application No. PCT/JP2016/081767, all pages.

(Continued)

*Primary Examiner* — George Wyszomierski

(74) *Attorney, Agent, or Firm* — HAUPTMAN HAM, LLP

(57) ABSTRACT

An nitrogen solid solution titanium sintered compact includes a matrix made of a titanium component having an α-phase, nitrogen atoms dissolved as a solute of solid solution in a crystal lattice of the titanium component, and metal atoms dissolved as a solute of solid solution in the crystal lattice of the titanium component.

13 Claims, 16 Drawing Sheets

(51) Int. Cl.
*B22F 3/14* (2006.01)
*B22F 3/24* (2006.01)

(56) References Cited

FOREIGN PATENT DOCUMENTS

| | | | |
|---|---|---|---|
| JP | H03150331 | A | 6/1991 |
| JP | H051342 | A | 1/1993 |
| JP | 2012255192 | A | 12/2012 |
| WO | 2015111361 | A1 | 7/2015 |

OTHER PUBLICATIONS

Sato, Kenji, et al., "Structure of Ti-N and Ti-B Based Sintered Alloys," pp. 1-6.
Koga, et al., "Structural and machanical properties of fine composites prepared by Ti-Si3N4 solid state reactions," Materials of Science and Engineering, Sep. 4, 1994, pp. 1-7.

* cited by examiner

Ti-N binary phase diagram

△ Ti ○ Nitride M-N ◆ Ti-M compound ◇ Metal M component

△ Ti ○ Nitride M-N ◆ Ti-M compound ◇ Metal M component

△ Ti ○ Nitride M-N ◆ Ti-M compound ◇ Metal M component

△ Ti ○ Nitride M-N ◆ Ti-M compound ◇ Metal M component

△ Ti ○ Nitride M-N ◆ Ti-M compound ◇ Metal M component

△ Ti ○ Nitride M-N ◆ Ti-M compound ◇ Metal M component

△ Ti ○ Nitride M-N ◆ Ti-M compound ◇ Metal M component

Ra; 26.6 μm

Ra; 10.4 μm

Ra; 6.2 μm

NITROGEN SOLID SOLUTION TITANIUM SINTERED COMPACT AND METHOD FOR PRODUCING SAME

RELATED APPLICATIONS

The present application is a Divisional of U.S. application Ser. No. 15/773,031, filed May 2, 2018, which is a U.S. National Phase of International Application Number PCT/JP2016/081767, filed Oct. 26, 2016, and claims the priority of Japanese Application No. 2015-215847, filed Nov. 2, 2015.

TECHNICAL FIELD

The present invention relates to a high-strength titanium material, and more particularly to a nitrogen solid solution titanium sintered compact in which nitrogen is dissolved as a solute of solid solution, as well as to a method for producing the same.

BACKGROUND ART

Titanium is a light-weight material having a low specific gravity of about ½ of that of steel and has excellent characteristics in corrosion resistance and strength, so that titanium is used in a component of an aircraft, a railway vehicle, a two-wheel vehicle, an automobile, or the like in which weight reduction is strongly demanded, or in a household electric appliance or an architectural member. Also, from the viewpoint of excellent corrosion resistance, titanium is also used as a material for medical use.

However, as compared with a steel material or an aluminum alloy, titanium has a high material cost, so that an object of use is limited. In particular, though having a high tensile strength exceeding 1000 MPa, a titanium alloy raises a problem of having an insufficient ductility (elongation after fracture) and also having a poor plastic formability at an ordinary temperature or in a low-temperature region. On the other hand, pure titanium raises a problem of low tensile strength of about 400 to 600 MPa, though having a high percentage elongation after fracture exceeding 25% at an ordinary temperature and being excellent in plastic formability in a low-temperature region.

Since the demand for compatibility between a high strength and a high ductility and for reduction of the material cost on titanium is extremely strong, various studies have been made so far. In particular, from the viewpoint of cost reduction, strengthening with use of a comparatively less expensive element such as oxygen and nitrogen instead of a highly expensive element such as vanadium, scandium, or niobium has been studied from the past.

For example, International Patent Publication WO2015/111361 (Patent Literature 1) proposes heating a titanium powder material made of titanium powder particles in an atmosphere containing nitrogen to dissolve nitrogen atoms as a solute of solid solution into a matrix of the titanium powder particles.

CITATION LIST

Patent Literatures

Patent Literature 1: International Patent Publication WO2015/111361

SUMMARY OF INVENTION

Technical Problem

In the method disclosed in International Patent Publication WO2015/111361, a titanium material is strengthened only by dissolving nitrogen atoms as a solute of solid solution; however, from the viewpoint of applying the titanium material to various purposes of use, it is desired that an improvement in the characteristics is exhibited by incorporation of other metal atoms or compounds in addition to solid solution strengthening by nitrogen atoms.

An object of the present invention is to provide a high-strength titanium sintered compact and a method for producing the same that can achieve an improvement in the characteristics by incorporating other metals or compounds into a matrix in addition to solid solution strengthening by nitrogen atoms.

Solution to Problem

In one aspect, a nitrogen solid solution titanium sintered compact according to the present invention includes a matrix made of a titanium component having an α-phase, nitrogen atoms dissolved as a solute of solid solution in a crystal lattice of the titanium component, and metal atoms dissolved as a solute of solid solution in the crystal lattice of the titanium component.

In one embodiment, a compound of the titanium component and the metal atoms exceeding a solid solubility limit of dissolving into the α-phase is dispersed in the matrix.

In another aspect, a nitrogen solid solution titanium sintered compact according to the present invention includes a matrix made of a titanium component having an α-phase, nitrogen atoms dissolved as a solute of solid solution in a crystal lattice of the titanium component, and a metal component that is present by being dispersed in the matrix.

In one embodiment, the metal component is made of metal atoms that are deposited in the matrix. In another embodiment, the metal component is a compound of metal atoms and the titanium component.

A metal of the metal atoms or metal component is a metal selected, for example, from the group consisting of Al, Si, Cr, V, Mo, Ta and Zr.

A method for producing a nitrogen solid solution titanium sintered compact according to the present invention includes a step of mixing a titanium component powder made of a titanium component having an α-phase with nitride particles of a metal other than titanium, a step of applying a compression force to shape a mixed powder obtained through the mixing, and a step of heating and sintering a compressed shaped compact, which is obtained through the compression shaping, in a solid-phase temperature region of an atmosphere that does not contain oxygen. The sintering step includes decomposing the metal nitride into metal atoms and nitrogen atoms, dissolving the nitrogen atoms, which have been dissociated from the metal nitride, as a solute of solid solution into a crystal lattice of the titanium component, and allowing the metal atoms, which have been dissociated from the metal nitride, to remain in a matrix of the titanium component.

The nitride, particles are, for example, nitride, particles of a metal selected from the group consisting of Al, Si, Cr, V, Mo, Ta and Zr.

Preferably, a lower limit of a heating and sintering temperature of the solid-phase temperature region is 700° C., and an upper limit of the heating and sintering temperature is a lower one of a temperature equal to or lower than a boiling point of the metal constituting the metal nitride and a temperature equal to or lower than a melting point of the titanium component.

The metal atoms dissociated from the metal nitride are dissolved as a solute of solid solution into the crystal lattice of the titanium component by a treatment of the heating and sintering. Alternatively, the metal atoms dissociated from the metal nitride react with the titanium component by a treatment of the heating and sintering to form a compound to be dispersed in the matrix. Alternatively, the metal atoms dissociated from the metal nitride are deposited in the matrix of the titanium component by a treatment of the heating and sintering.

In one embodiment, the compression shaping step and the sintering step are simultaneously carried out. Preferably, the method for producing a nitrogen solid solution titanium sintered compact further includes a step of performing a homogenizing heat treatment on the sintered compact obtained after the heating and sintering. Also, preferably, the method for producing a nitrogen solid solution titanium sintered compact further includes a step of performing plastic forming of the sintered compact obtained after the heating and sintering.

Advantageous Effects of Invention

According to the present invention, a high-strength titanium material sintered compact can be obtained by solid solution strengthening of nitrogen atoms dissociated from the metal nitride and solid solution strengthening, deposition strengthening, or dispersion strengthening of metal atoms dissociated from the metal nitride.

DESCRIPTION OF EMBODIMENTS

[Binary Phase Diagram of Ti—N]

Figure 1:
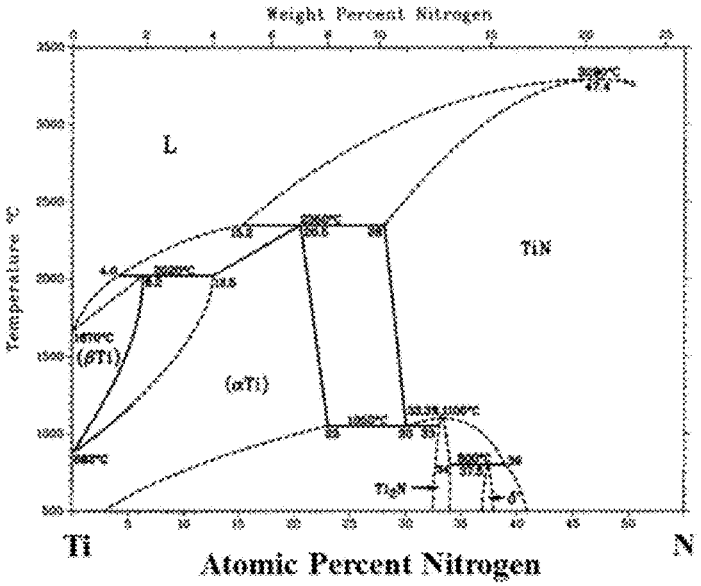
FIG. 1 is a binary phase diagram of titanium and nitrogen.

FIG. 1 shows a binary phase diagram of titanium and nitrogen. As will be clear from FIG. 1, an α-Ti crystal can dissolve nitrogen as a solute of solid solution up to 33 atom % at the maximum. The reason why such a large amount of nitrogen can be dissolved as a solute of solid solution is that the α-Ti crystal has a hexagonal close-packed structure (hcp). Titanium is the only element that can dissolve a large amount of nitrogen as a solute of solid solution, and this characteristic feature cannot be seen in the other metals.

However, when a titanium material is fabricated by the melting method, it is not possible to dissolve a large amount of nitrogen as a solute of solid solution. This is because, in a liquid phase state, a crystal lattice is not formed, and titanium takes up nitrogen only when titanium is brought into a solid phase state to form a crystal lattice having the hexagonal close-packed structure.

[Standard Free Energy of Formation of Nitride—Temperature Diagram]

Accordingly, the inventor of the present application has made a study on whether a reaction between titanium and a metal nitride can be used or not as a technique for incorporating nitrogen atoms into a matrix of titanium in a solid phase state.

Figure 2:
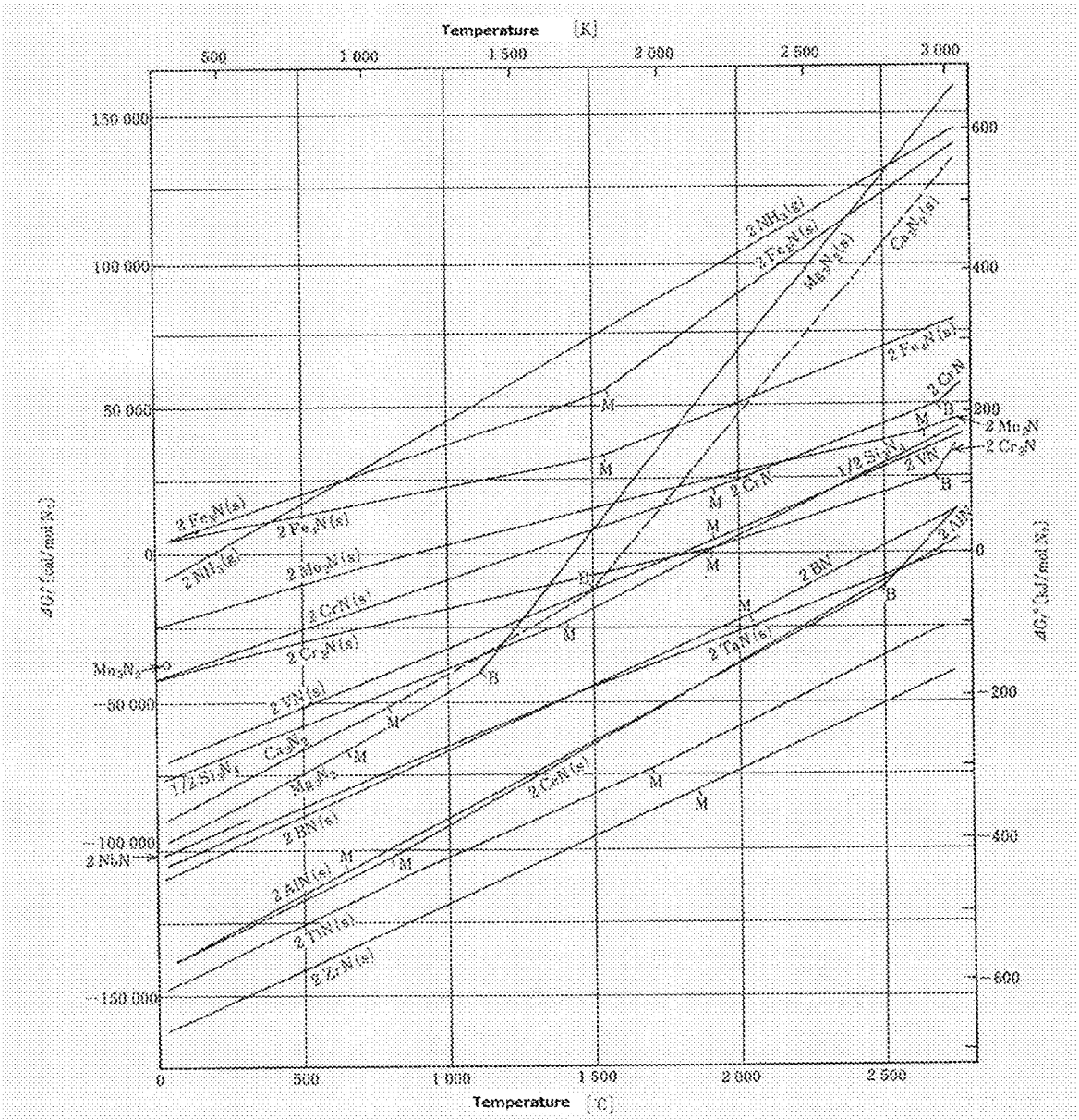
FIG. 2 is a view showing a relationship between the standard free energy of formation of nitride and temperature.

FIG. 2 is a diagram showing a relationship between the standard free energy of formation of nitride and the temperature. The source of this diagram is "Metal Data Book, revised 3rd edition" (Editor: Corporate Juridical Person of The Japan Institute of Metals and Materials) published by Maruzen Publishing Co., Ltd. In the graph of FIG. 2, a metal nitride whose standard free energy of formation on the longitudinal axis is positioned below (that is, having a lower energy) in a specific temperature region shown on the lateral axis has a higher stability than a metal nitride whose standard free energy of formation is positioned above (that is, having a higher energy). Therefore, according to the principle of thermodynamics, it can be expected that a metal ML whose standard free energy of formation is positioned below in a specific temperature region exhibits a decomposition function on a nitride of a metal MU whose standard free energy of formation is positioned above, whereby the metal ML decomposes the nitride of the metal MU and takes up the dissociated nitrogen atoms.

In order to verify this expectation, the inventor of the present application has conducted an experiment of sintering a mixed powder of titanium powder and nitride particles of a metal MU whose standard free energy of formation is higher than that of titanium (Ti) in the graph of FIG. 2, in a solid phase state (below the melting point of titanium). As a result of this, it has been confirmed that the nitride of the metal MU is decomposed; the dissociated nitrogen atoms are dissolved as a solute of solid solution in the crystal lattice of titanium; and moreover, the dissociated atoms of the metal MU are dissolved as a solute of solid solution in the crystal lattice of titanium, deposited in a matrix of titanium, or dispersed in the matrix of titanium by forming a compound with titanium.

Further, the inventor of the present application has found out a phenomenon such that even a nitride of a metal ML whose standard free energy of formation is positioned below that of titanium nitride is decomposed by reacting with titanium at the time of sintering in the solid phase state, thereby to dissociate nitrogen atoms and metal atoms. It has been confirmed that the dissociated nitrogen atoms are dissolved as a solute of solid solution in the crystal lattice of titanium; and moreover, the dissociated atoms of the metal ML are dissolved as a solute of solid solution in the crystal lattice of titanium, deposited in the matrix of titanium, or dispersed in the matrix of titanium by forming a compound with titanium. Such a behavior is against the principle of thermodynamics and is a phenomenon that is seen only in a sintering process in a solid-phase temperature region using a titanium powder.

[Mixed Powder of Titanium Powder and Metal Nitride Particles Used in the Experiment]

A material of the titanium powder used in the experiment was pure titanium. Pure titanium can dissolve a large amount of nitrogen atoms and the like as a solute of solid solution because of having an α phase (crystal lattice of the hexagonal close-packed structure). Although not used in the experiment of this time, even a titanium alloy powder having an α phase, when used instead of pure titanium powder, can dissolve a large amount of nitrogen atoms and the like as a solute of solid solution in the same manner as pure titanium. As an example of a titanium alloy having an α phase, Ti-6% Al-4% V, Ti—Al—Fe-based titanium alloy, Ti—Al—Fe—Si-based titanium alloy, and the like can be mentioned.

An average particle size of the pure titanium powder used in the experiment was 28 μm; however, those having a particle size up to about 10 μm to 150 μm may likewise be used.

As a metal that forms the metal nitride, it is possible to use Al, Si, Cr, V, Mo, Ta, Zr, and the like. As nitrides of these metals, metal nitrides having a standard free energy of formation higher than TiN (that is, being thermodynamically more unstable than TiN) in a temperature range of solid phase sintering are AlN, $Si_3N_4$, $Cr_2N$, VN, $Mo_2N$, and TaN. On the other hand, metal nitrides having a standard free energy of formation lower than TiN (that is, being thermodynamically more stable than TiN) in the temperature range of solid phase sintering are ZrN.

An average particle size of the metal nitride particles is about 1 μm to 10 μp. A surface of the titanium component powder particles is preferably coated with an oil having an adhesive property in advance in order that the metal nitride particles may be dispersed on the titanium component powder particles without being aggregated at the time of mixing.

[Method for Producing Sintered Compact]

(1) Mixing Step

A pure titanium powder having an average particle size of 28 μm and various kinds of metal nitride particles were mixed under a dry condition with use of a ball mill. The amount of the metal nitride particles is preferably set to be within a range of 0.1% to 7% in terms of mass with respect to the total mixed powder. When the amount of the metal nitride particles is less than 0.1%, the effect of metal nitride particle addition is not fully exhibited. On the other hand, when the amount of the metal nitride particles exceeds 7%, the titanium material sintered compact tends to be brittle because of becoming excessively hard.

The mixing treatment conditions in conducting the experiment with use of the ball mill are as follows.

Dry mixing treatment using a ball mill

Rotation number: 90 rpm

Mixing time: 1 H

Amount of metal nitride relative to the total mixed powder: 5 mass %

(2) Shaping Step

A compression force was applied to shape the mixed powder obtained by the mixing treatment described above. This compression shaping may be carried out separately from the sintering step or may be carried out simultaneously with the sintering treatment.

When the compression shaping is carried out before the sintering treatment, the compression shaping may be carried out either under a cold condition or under a hot condition. Since a mold made of steel can be used as the shaping mold, the shaping pressure can be set to be about 300 to 800 MPa.

In a spark plasma sintering treatment in which the compression shaping and the solid-phase sintering are simultaneously carried out, a mold made of carbon is used as the shaping mold, so that the shaping pressure must be set to be about 100 MPa or less in view of the strength of the mold.

(3) Sintering Step

In the experiment, the spark plasma sintering treatment was carried out while shaping the mixed powder by applying a pressurizing force of 30 MPa to the mixed powder. The conditions of a spark plasma sintering treatment apparatus were as follows.

Sintering temperature: 1000° C. (solid-phase temperature region)

Holding time: 1 H

Atmosphere: vacuum (4 Pa or less)

A lower limit of the sintering temperature is about 700° C. at which the metal nitride is decomposed. An upper limit of the sintering temperature is the lower one of a temperature equal to or lower than the melting point of the titanium component and a temperature equal to or lower than the boiling point of the metal constituting the metal nitride.

When the sintering step is carried out separately from the compression shaping step, the atmosphere during the sintering need not be set to be a vacuum atmosphere, so that the atmosphere during the sintering may be an inert gas atmosphere that does not contain oxygen.

During the sintering treatment described above, the metal nitride is decomposed into nitrogen atoms and metal atoms. The dissociated nitrogen atoms are dissolved as a solute of solid solution into the crystal lattice of the hexagonal close-packed structure of the titanium component. The dissociated metal atoms perform one of the following behaviors depending on the type of the metal.

a) The dissociated metal atoms are dissolved as a solute of solid solution into the crystal lattice of the hexagonal close-packed structure of the titanium component.

b) The dissociated metal atoms are deposited in the matrix of the titanium component. The deposition is either within the crystal and/or on the crystal grain boundary.

c) The dissociated metal atoms react with the titanium component to be dispersed in the matrix of the titanium component. The dispersion is either within the crystal and/or on the crystal grain boundary.

(4) Homogenizing Heat Treatment Step

Preferably, a heat treatment for homogenizing the structure of the sintered compact obtained after the heating and sintering was carried out.

(5) Hot Plastic Forming Step

The sintered compact subjected to the homogenizing heat treatment was subjected to hot extrusion forming. The hot extrusion forming is one type of the plastic forming; however, hot forging forming or hot rolling forming may be carried out in place of the hot extrusion forming. By subjecting the sintered compact to the hot plastic forming, the strength of the nitrogen solid solution titanium sintered compact can be further improved. The samples of the tensile test described later were obtained by subjecting the sintered compact to hot extrusion forming.

[Evaluation on the Characteristics of Sintered Compact]

The inventor of the present application has confirmed through the following evaluation that, by mixing a powder made of a titanium component with nitride particles of a metal other than titanium and pressure-sintering the obtained mixture, the nitrogen atoms and the metal atoms dissociated from the metal nitride are dissolved as a solute of solid solution, deposited, or dispersed in the titanium material, that the hardness of the sintered compact is increased, and further that the tensile strength of the extruded material of the sintered compact is increased.

a) X-ray diffraction of raw material mixed powder (before sintering) and sintered compact b) Structure micrograph of sintered compact c) Measurement of micro Vickers hardness (Hv) of sintered compact d) Tensile test of sintered compact extruded material at ordinary temperature e) Abrasion test of sintered compact extruded material

[Confirmation on Decomposition of Metal Nitride and Behavior of Dissociated Nitrogen Atoms and Metal Atoms]

FIGS. 3 to 9 are diagrams showing an X-ray diffraction result, where the line located at the lowermost position represents the mixed powder of pure titanium and metal nitride particles (before sintering); the line located at the uppermost position represents the metal nitride particles; and the line located at the middle position represents the sintered compact after the spark plasma sintering treatment. In each diagram, the symbol "○" indicates a peak showing the presence of metal nitride; the symbol "Δ" indicates a peak showing pure titanium; the symbol "◆" indicates a peak showing the compound of titanium and the metal; and the symbol "◇" indicates a peak showing the metal component.

(1) Ti+5 mass % AlN

Figure 3:
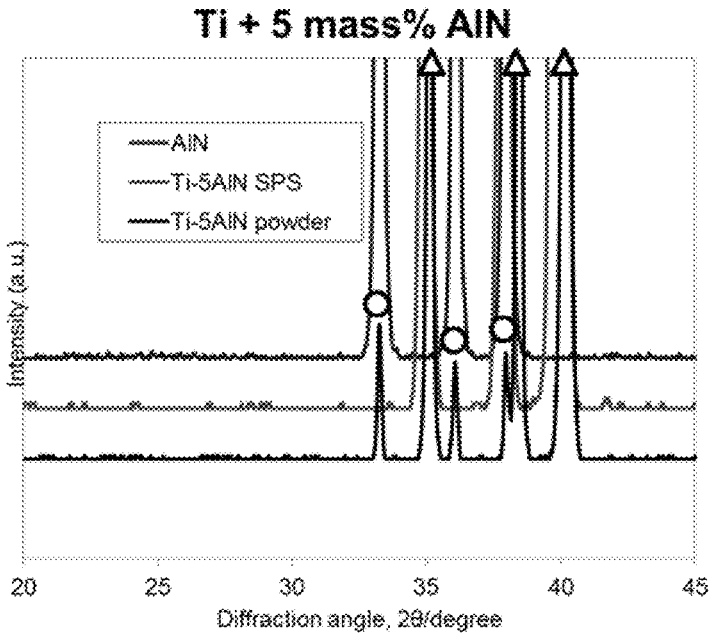
FIG. 3 is a view showing an X-ray diffraction result of Ti+5 mass % AlN-based mixed powder and sintered compact.

Reference is made to the mixed powder of Ti+5 mass % AlN shown in FIG. 3. In the AlN particles (the line located at the uppermost position), the peak "○" of AlN appears at the diffraction angles near 33 degrees and near 36 degrees. In the mixed powder (the line located at the lowermost position), the peak of AlN appears, and also the peak "4" of pure titanium appears at the diffraction angles near 35 degrees, near 38 degrees, and near 40 degrees.

When attention is paid to the sintered compact (the line located at the middle position), it is found out that the peaks of AlN at the diffraction angles near 33 degrees and near 36 degrees have disappeared. This means that AlN has been decomposed by the sintering treatment. It is recognized that, though the peak of pure titanium appears at the diffraction angles near 35 degrees, near 38 degrees, and near 40 degrees, the position of the peak of pure titanium after the sintering treatment is shifted toward one angle side as compared with that before the sintering. This is because the nitrogen atoms and aluminum atoms dissociated by decomposition of the aluminum nitride are dissolved as a solute of solid solution in the crystal lattice of the hexagonal close-packed structure of titanium.

Figure 10:
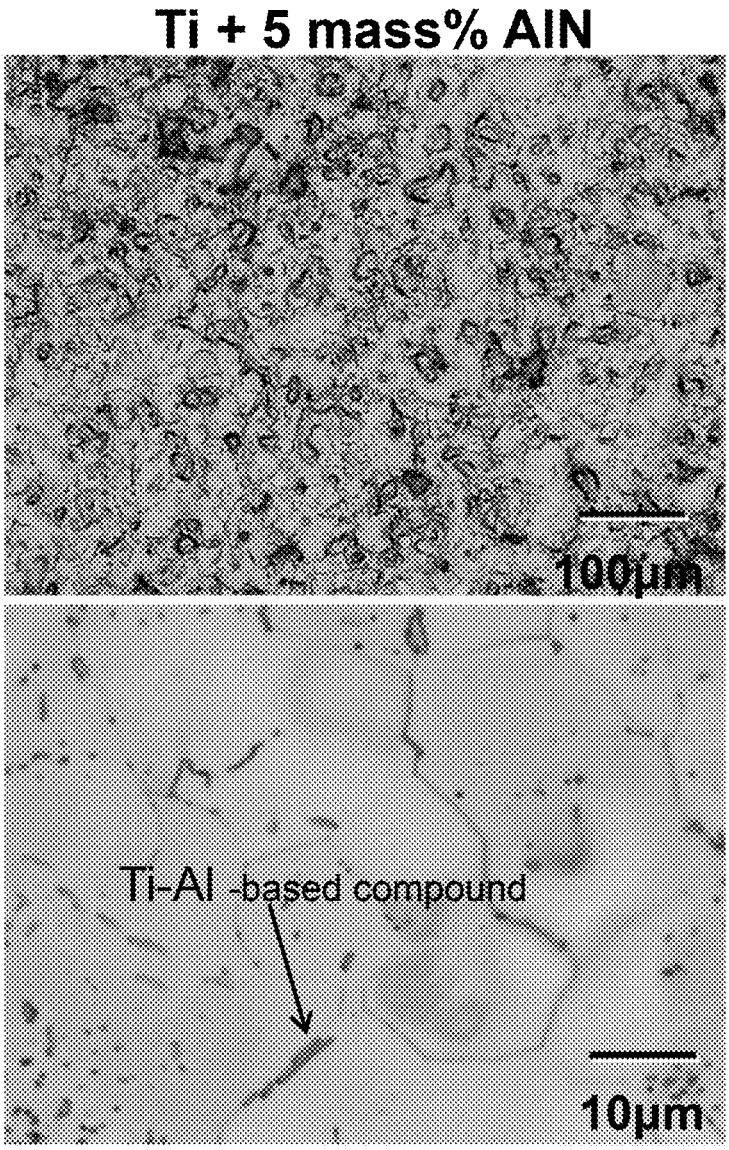
FIG. 10 is a structure micrograph of Ti+5 mass % AlN-based mixed powder and sintered compacts.

When the structure micrograph of FIG. 10 is seen, it can be confirmed that the aluminum atoms dissociated by decomposition of the aluminum nitride have reacted with titanium to form the Ti—Al-based compound to be dispersed in the matrix of titanium.

(2) Ti+5 mass % $Si_3N_4$

Figure 4:
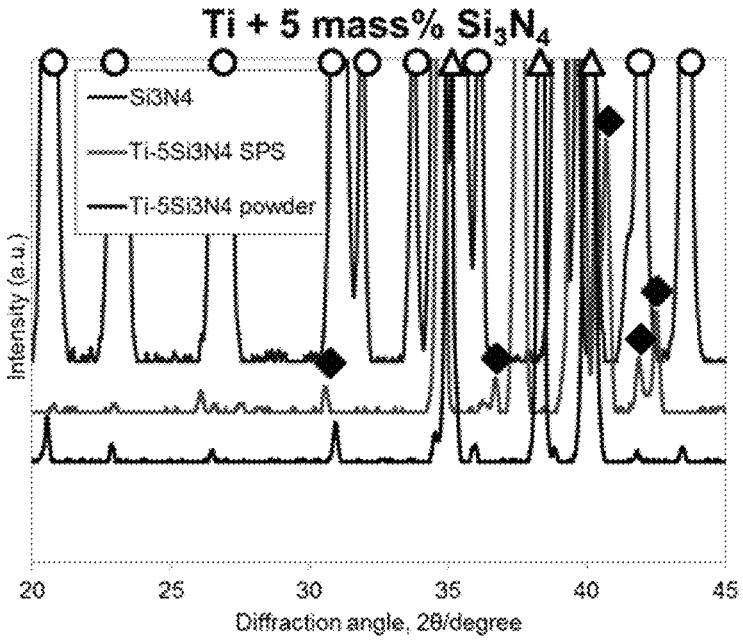
FIG. 4 is a view showing an X-ray diffraction result of Ti+5 mass % $Si_3N_4$-based mixed powder and sintered compact.

Reference is made to the mixed powder of Ti+5 mass % $Si_3N_4$ shown in FIG. 4. In the $Si_3N_4$ particles (the line located at the uppermost position), the peak "○" of $Si_3N_4$ appears, for example, at the diffraction angles near 20 degrees. In the mixed powder (the line located at the lowermost position), the peak of $Si_3N_4$ appears, and also the peak "4" of pure titanium appears at the diffraction angles near 35 degrees, near 38 degrees, and near 40 degrees.

When attention is paid to the sintered compact (the line located at the middle position), it is found out that the peak of $Si_3N_4$ at the diffraction angle near 20 degrees has disappeared. This means that $Si_3N_4$ has been decomposed by the sintering treatment. It is recognized that, though the peak of pure titanium appears at the diffraction angles near 35 degrees, near 38 degrees, and near 40 degrees, the position of the peak of pure titanium after the sintering treatment is shifted toward one angle side as compared with that before the sintering. This is because the nitrogen atoms and silicon atoms dissociated by decomposition of the silicon nitride are dissolved as a solute of solid solution in the crystal lattice of the hexagonal close-packed structure of titanium.

When further attention is paid to the sintered compact, it is found out that a peak of a compound of titanium and silicon (Ti—Si-based compound) newly appears. This means that the silicon atoms dissociated by decomposition of the silicon nitride have reacted with titanium to form the Ti—Si-based compound to be dispersed in the matrix of titanium.

Figure 11:
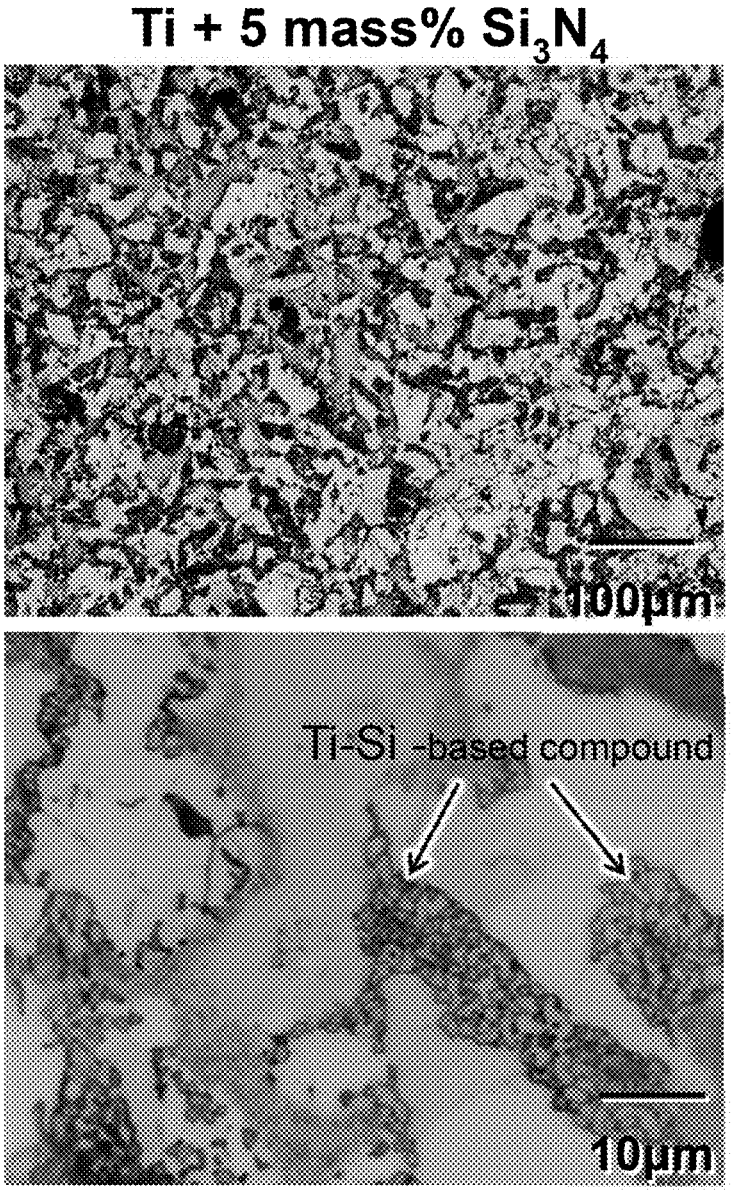
FIG. 11 is a structure micrograph of Ti+5 mass % $Si_3N_4$-based mixed powder and sintered compacts.

When the structure micrograph of FIG. 11 is seen, it can be confirmed that the Ti—Si-based compound is dispersed in the matrix of titanium.

(3) Ti+5 mass % $Cr_2N$

Figure 5:
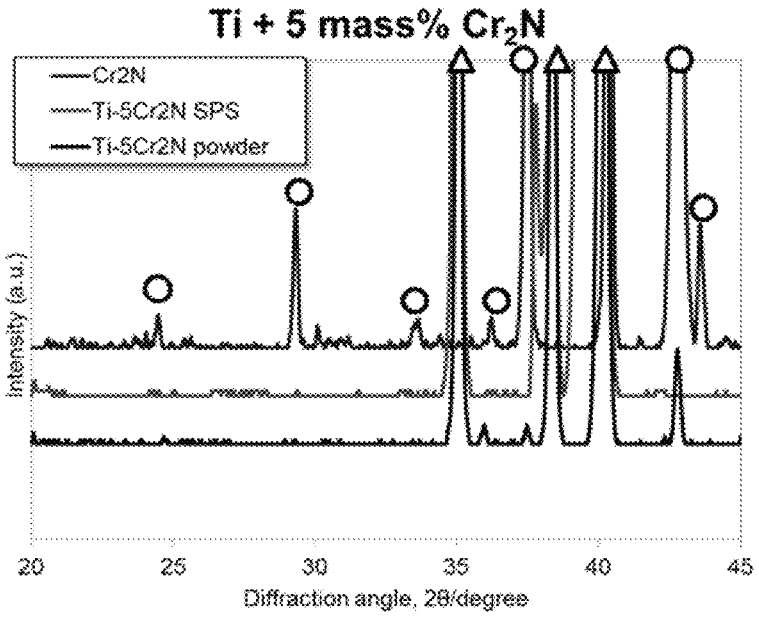
FIG. 5 is a view showing an X-ray diffraction result of Ti+5 mass % $Cr_2N$-based mixed powder and sintered compact.

Reference is made to the mixed powder of Ti+5 mass % $Cr_2N$ shown in FIG. 5. In the $Cr_2N$ particles (the line located at the uppermost position), the peak "○" of $Cr_2N$ appears, for example, at the diffraction angles near 42 degrees. In the mixed powder (the line located at the lowermost position), the peak of $Cr_2N$ appears, and also the peak "4" of pure titanium appears at the diffraction angles near 35 degrees, near 38 degrees, and near 40 degrees.

When attention is paid to the sintered compact (the line located at the middle position), it is found out that the peak of $Cr_2N$ at the diffraction angle near 42 degrees has disappeared. This means that $Cr_2N$ has been decomposed by the sintering treatment. It is recognized that, though the peak of pure titanium appears at the diffraction angles near 35 degrees, near 38 degrees, and near 40 degrees, the position of the peak of pure titanium after the sintering treatment is shifted toward one angle side as compared with that before the sintering. This is because the nitrogen atoms and chromium atoms dissociated by decomposition of the chromium nitride are dissolved as a solute of solid solution in the crystal lattice of the hexagonal close-packed structure of titanium.

When further attention is paid to the sintered compact, it is found out that neither a peak of a compound of titanium and chromium (Ti—Cr-based compound) nor a peak of chromium appears. This means that all of the chromium atoms dissociated by decomposition of chromium nitride are dissolved as a solute of solid solution in the crystal lattice of the hexagonal close-packed structure of titanium.

Figure 12:
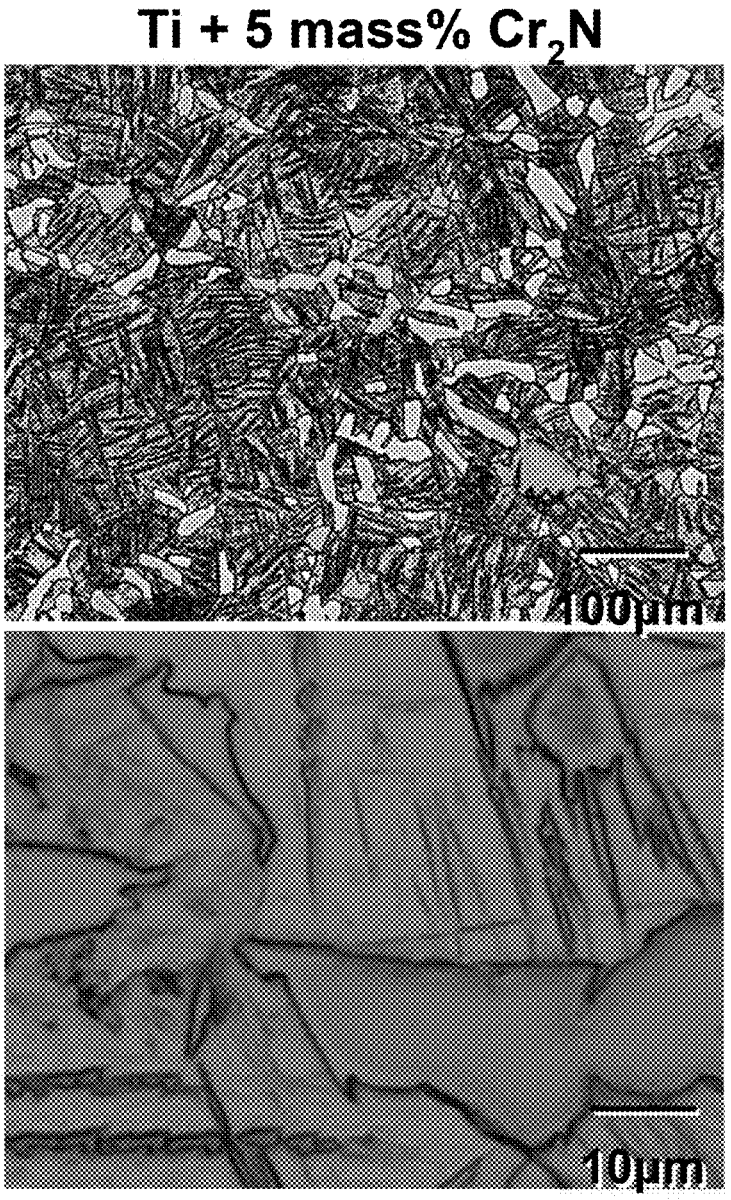
FIG. 12 is a structure micrograph of Ti+5 mass % $Cr_2N$-based mixed powder and sintered compacts.

When the structure micrograph of FIG. 12 is seen, it can be confirmed that neither the Ti—Cr-based compound nor the Cr component appears in the matrix of titanium.

(4) Ti+5 mass % VN

Figure 6:
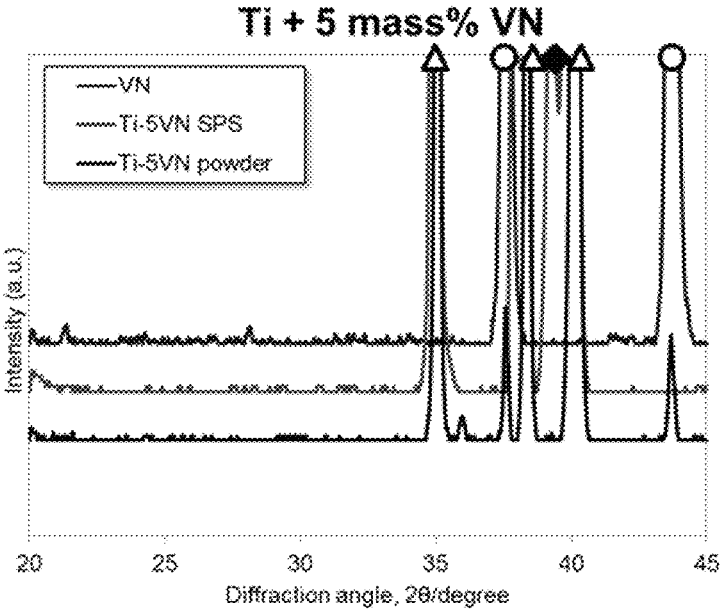
FIG. 6 is a view showing an X-ray diffraction result of Ti+5 mass % VN-based mixed powder and sintered compacts.

Reference is made to the mixed powder of Ti+5 mass % VN shown in FIG. 6. In the VN particles (the line located at the uppermost position), the peak "○" of VN appears, for example, at the diffraction angle near 44 degrees. In the mixed powder (the line located at the lowermost position) also, the peak "○" of VN appears at the diffraction angle near 44 degrees, and also the peak "Δ" of pure titanium appears at the diffraction angles near 35 degrees, near 38 degrees, and near 40 degrees.

When attention is paid to the sintered compact (the line located at the middle position), it is found out that the peak of VN at the diffraction angle near 44 degrees has disappeared. This means that VN has been decomposed by the sintering treatment. It is recognized that, though the peak of pure titanium appears at the diffraction angles near 35 degrees, near 38 degrees, and near 40 degrees, the position of the peak of pure titanium after the sintering treatment is shifted toward one angle side as compared with that before the sintering. This is because the nitrogen atoms and vanadium atoms dissociated by decomposition of the vanadium nitride are dissolved as a solute of solid solution in the crystal lattice of the hexagonal close-packed structure of titanium.

When further attention is paid to the sintered compact, it is found out that a peak of a compound of titanium and vanadium (Ti—V-based compound) newly appears at the diffraction angle near 44 degrees. This means that the vanadium atoms dissociated by decomposition of the vanadium nitride have reacted with titanium to form the Ti—V-based compound to be dispersed in the matrix of titanium.

Figure 13:
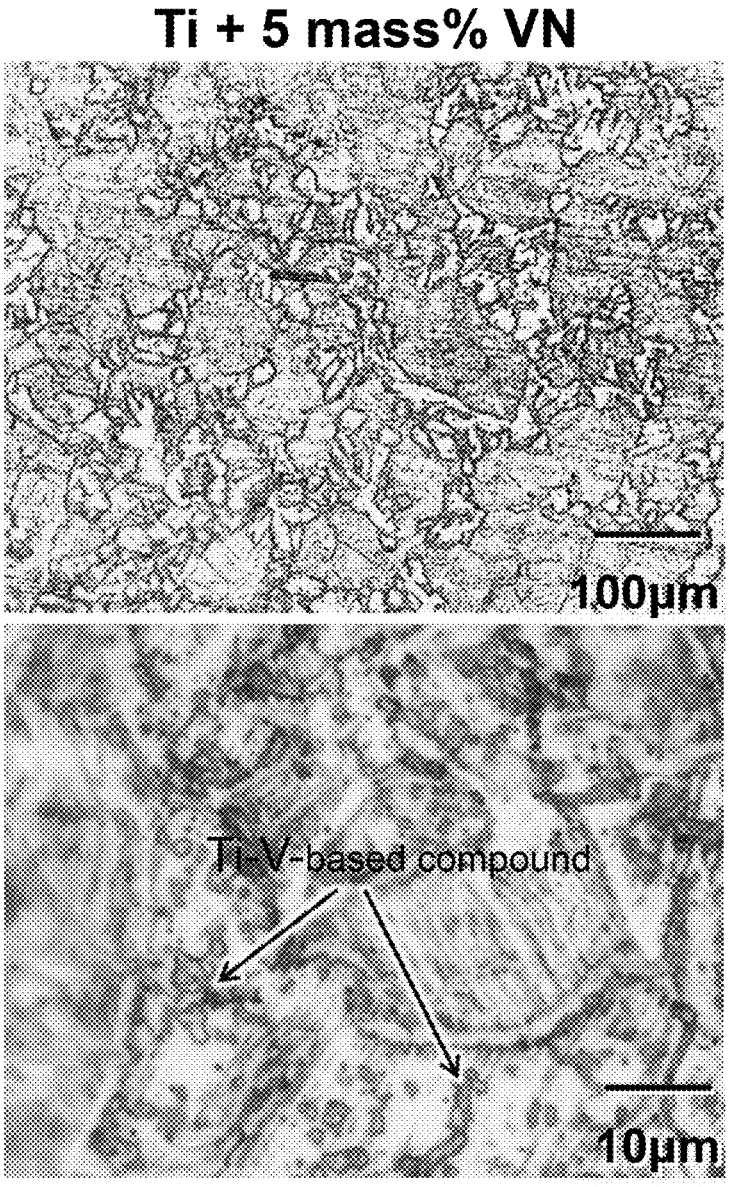
FIG. 13 is a structure micrograph of Ti+5 mass % VN-based mixed powder and sintered compacts.

When the structure micrograph of FIG. 13 is seen, it can be confirmed that the Ti—V compound is dispersed in the matrix of titanium.

(5) Ti+5 mass % $Mo_2N$

Figure 7:
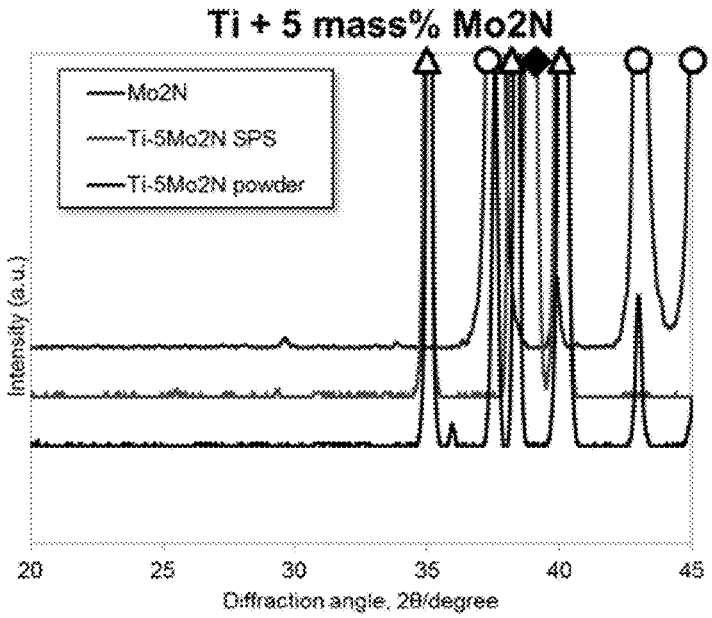
FIG. 7 is a view showing an X-ray diffraction result of Ti+5 mass % $Mo_2N$-based mixed powder and sintered compacts.

Reference is made to the mixed powder of Ti+5 mass % $Mo_2N$ shown in FIG. 7. In the $Mo_2N$ particles (the line located at the uppermost position), the peak "○" of $Mo_2N$ appears, for example, at the diffraction angle near 43 degrees. In the mixed powder (the line located at the lowermost position) also, the peak of $Mo_2N$ appears at the diffraction angle near 43 degrees, and also the peak "Δ" of pure titanium appears at the diffraction angles near 35 degrees, near 38 degrees, and near 40 degrees.

When attention is paid to the sintered compact (the line located at the middle position), it is found out that the peak of $Mo_2N$ at the diffraction angle near 43 degrees has disappeared. This means that $Mo_2N$ has been decomposed by the sintering treatment. It is recognized that, though the peak of pure titanium appears at the diffraction angles near 35 degrees, near 38 degrees, and near 40 degrees, the position of the peak of pure titanium after the sintering treatment is shifted toward one angle side as compared with that before the sintering. This is because the nitrogen atoms and molybdenum atoms dissociated by decomposition of the molybdenum nitride are dissolved as a solute of solid solution in the crystal lattice of the hexagonal close-packed structure of titanium.

When further attention is paid to the sintered compact, it is found out that a peak of a compound of titanium and molybdenum (Ti—Mo-based compound) newly appears at the diffraction angle near 39 degrees. This means that the molybdenum atoms dissociated by decomposition of the molybdenum nitride have reacted with titanium to form the Ti—Mo-based compound to be dispersed in the matrix of titanium.

Figure 14:
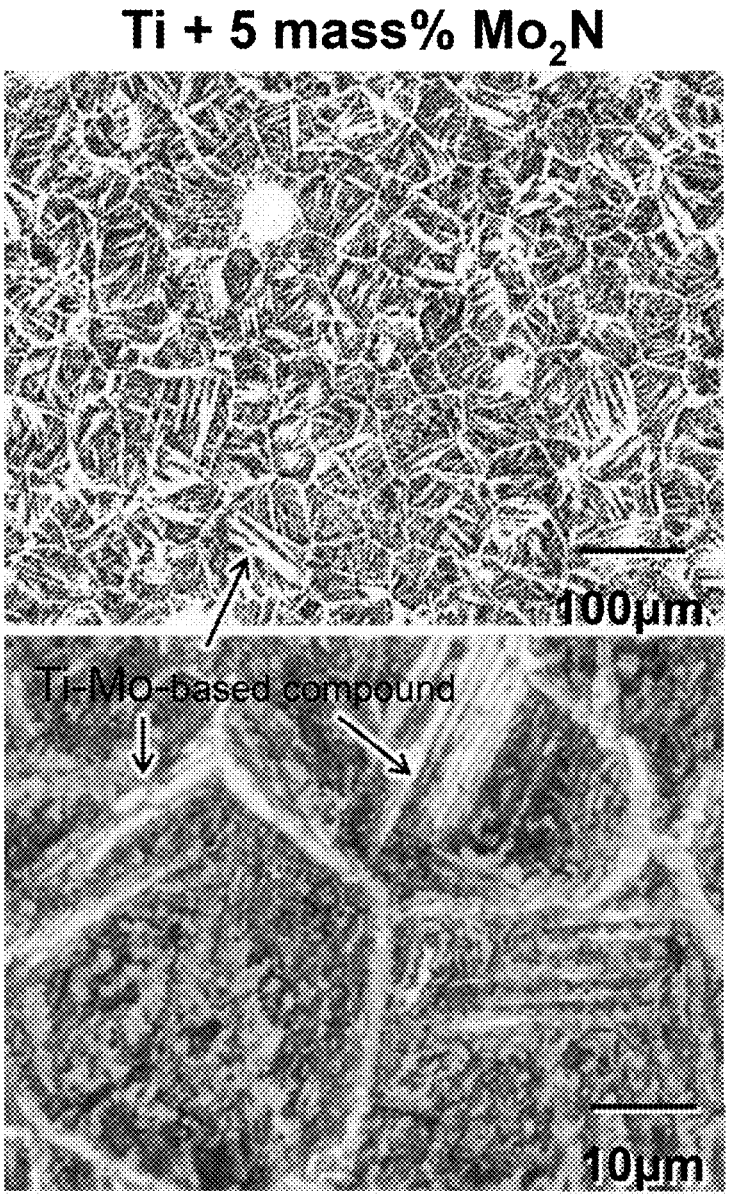
FIG. 14 is a structure micrograph of Ti+5 mass % $Mo_2N$-based mixed powder and sintered compacts.

When the structure micrograph of FIG. 14 is seen, it can be confirmed that the Ti—Mo-based compound is dispersed in the matrix of titanium.

(6) Ti+5 mass % TaN

Figure 8:
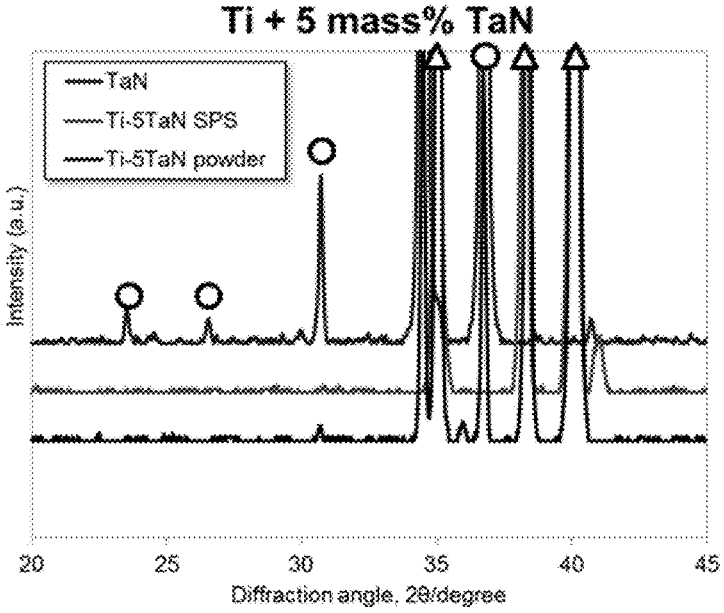
FIG. 8 is a view showing an X-ray diffraction result of Ti+5 mass % TaN-based mixed powder and sintered compacts.

Reference is made to the mixed powder of Ti+5 mass % TaN shown in FIG. 8. In the TaN particles (the line located at the uppermost position), the peak "○" of TaN appears, for example, at the diffraction angle near 31 degrees. In the mixed powder (the line located at the lowermost position), the peak of TaN appears at the diffraction angle near 31 degrees, and also the peak "Δ" of pure titanium appears at the diffraction angles near 35 degrees, near 38 degrees, and near 40 degrees.

When attention is paid to the sintered compact (the line located at the middle position), it is found out that the peak of TaN at the diffraction angle near 31 degrees has disappeared. This means that TaN has been decomposed by the sintering treatment. It is recognized that, though the peak of pure titanium appears at the diffraction angles near 35 degrees, near 38 degrees, and near 40 degrees, the position of the peak of pure titanium after the sintering treatment is shifted toward one angle side as compared with that before the sintering. This is because the nitrogen atoms and tantalum atoms dissociated by decomposition of the tantalum nitride are dissolved as a solute of solid solution in the crystal lattice of the hexagonal close-packed structure of titanium.

When further attention is paid to the sintered compact, it is found out that neither a peak of a compound of titanium and tantalum (Ti—Ta-based compound) nor a peak of tantalum appears. This means that all of the tantalum atoms dissociated by decomposition of tantalum nitride are dissolved as a solute of solid solution in the crystal lattice of the hexagonal close-packed structure of titanium.

Figure 15:
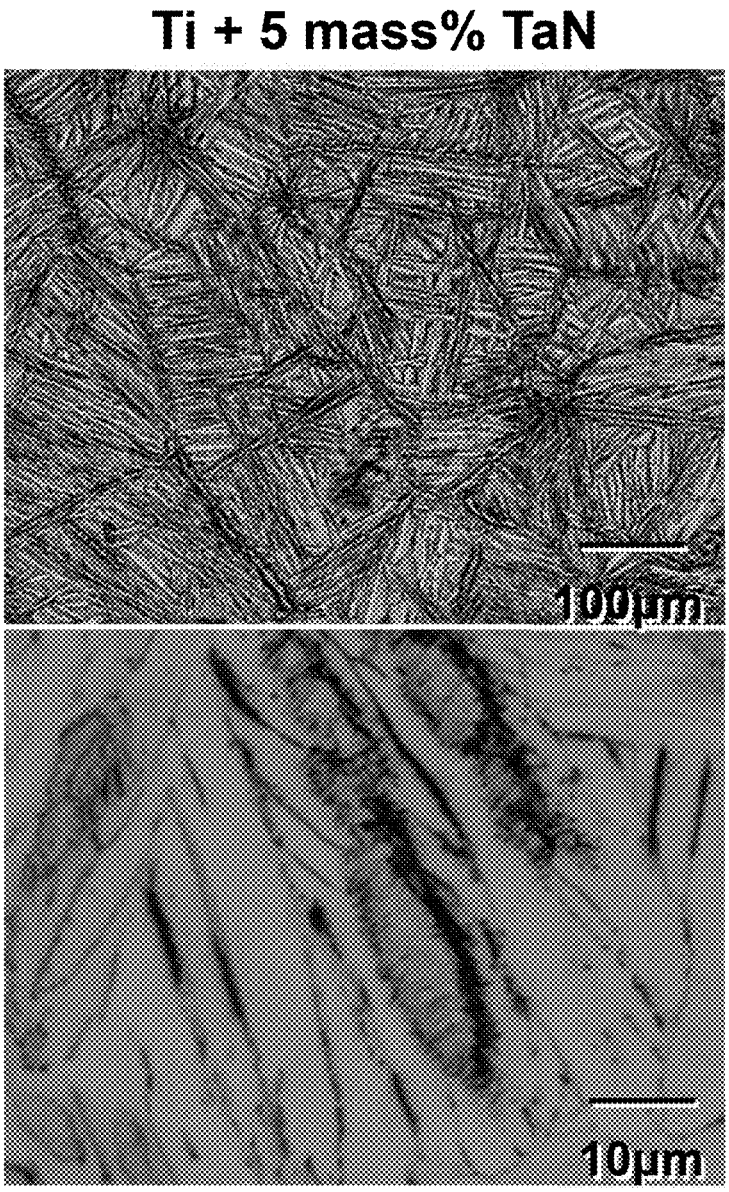
FIG. 15 is a structure micrograph of Ti+5 mass % TaN-based mixed powder and sintered compacts.

When the structure micrograph of FIG. 15 is seen, it can be confirmed that neither the Ti—Ta-based compound nor the Ta component appears in the matrix.

(7) Ti+5 mass % ZrN

Figure 9:
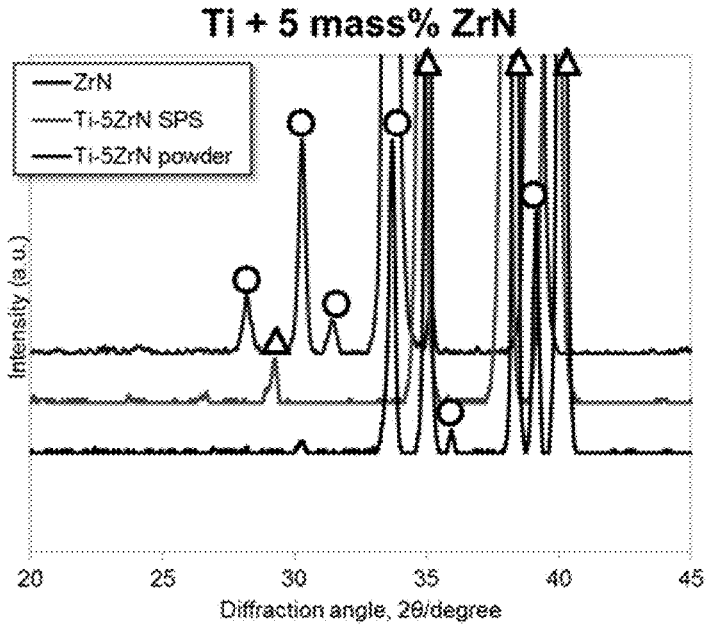
FIG. 9 is a view showing an X-ray diffraction result of Ti+5 mass % ZrN-based mixed powder and sintered compacts.

Reference is made to the mixed powder of Ti+5 mass % ZrN shown in FIG. 9. In the ZrN particles (the line located at the uppermost position), the peak "○" of ZrN appears, for example, at the diffraction angle near 30 degrees. In the mixed powder (the line located at the lowermost position) also, the peak of ZrN appears at the diffraction angle near 30 degrees, and also the peak "4" of pure titanium appears at the diffraction angles near 35 degrees, near 38 degrees, and near 40 degrees.

When attention is paid to the sintered compact (the line located at the middle position), it is found out that the peak of ZrN at the diffraction angle near 30 degrees has disappeared. This means that ZrN has been decomposed by the sintering treatment. It is recognized that, though the peak of pure titanium appears at the diffraction angles near 35 degrees, near 38 degrees, and near 40 degrees, the position of the peak of pure titanium after the sintering treatment is shifted toward one angle side as compared with that before the sintering. This is because the nitrogen atoms and zirconium atoms dissociated by decomposition of the zirconium nitride are dissolved as a solute of solid solution in the crystal lattice of the hexagonal close-packed structure of titanium.

When further attention is paid to the sintered compact, it is found out that neither a peak of a compound of titanium and zirconium (Ti—Zr-based compound) nor a peak of zirconium appears. This means that all of the zirconium atoms dissociated by decomposition of zirconium nitride are dissolved as a solute of solid solution in the crystal lattice of the hexagonal close-packed structure of titanium.

Figure 16:
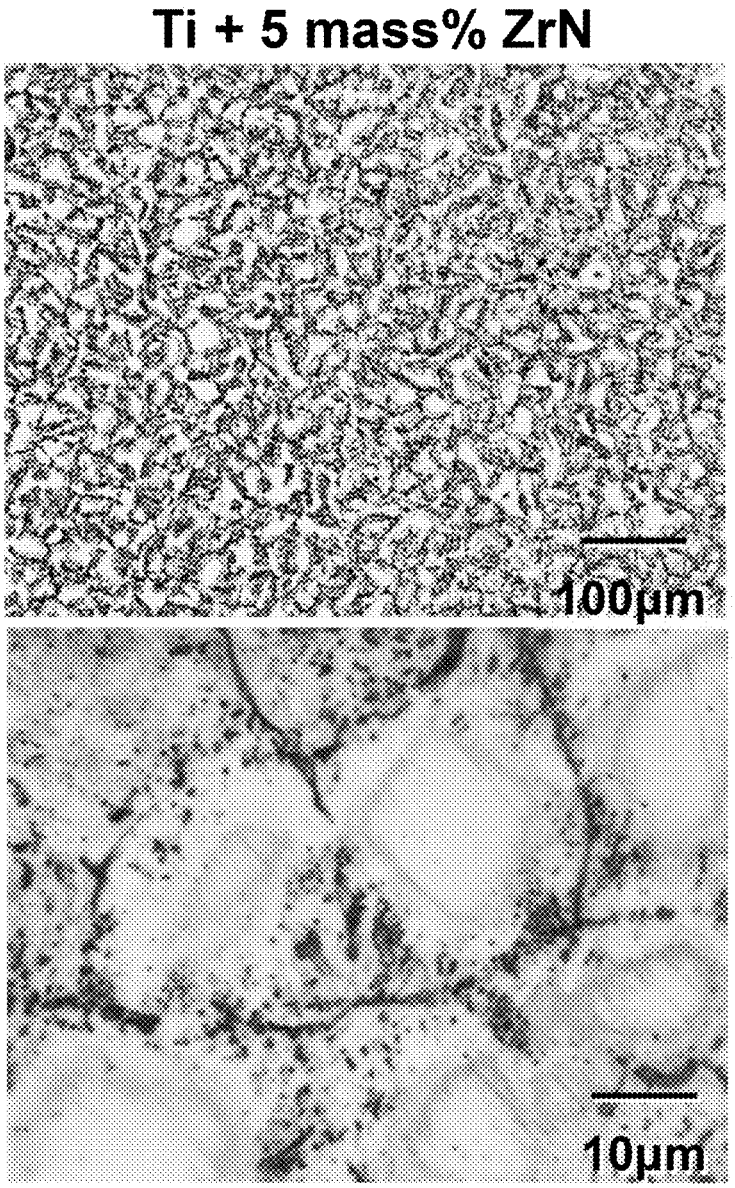
FIG. 16 is a structure micrograph of Ti+5 mass % ZrN-based mixed powder and sintered compacts.

When the structure micrograph of FIG. 16 is seen, it can be confirmed that neither the Ti—Zr-based compound nor the Zr component appears in the matrix of titanium.

[Result of Micro Vickers (Hv) Hardness Measurement of Sintered Compact]

The sintered compacts of various types described above (those obtained by performing spark plasma sintering on a shaped compact of a mixed powder of pure titanium powder and metal nitride particles) were subjected to extrusion forming under the following conditions, so as to prepare samples for hardness measurement and tensile strength measurement.

The micro Vickers hardness (Hv) was measured under the following conditions to give the following results. Here, for each sample, hardness was measured at 20 sites, and an average hardness thereof was calculated.

Hardness measurement conditions: load weight of 100 g/time for 15 seconds

Pure Ti: 208

Ti+5% AlN: 887

Ti+5% $Si_3N_4$: 938

Ti+5% $Cr_2N$: 400

Ti+5% VN: 367

Ti+5% $Mo_2N$: 358

Ti+5% TaN: 339

Ti+5% ZrN: 380

As will be clear from the above measurement results, a compact obtained by sintering a mixed powder of pure titanium powder and metal nitride particles shows a considerable rise in the micro Vickers hardness as compared with pure titanium. In particular, rise in the hardness is considerable in the sintered compact of Ti+5% AlN, and sintered compact of Ti+5% $Si_3N_4$. The reason why the hardness of the sintered compact rises in this manner is that, at the time of sintering treatment, the metal nitride is decomposed, and the dissociated nitrogen atoms are dissolved as a solute of solid solution in the crystal lattice of titanium, and further the dissociated metal atoms form a compound with titanium to be dispersed in the matrix of titanium, thereby increasing the strength.

[Method of Production and Result of Tensile and Abrasion Test of Ti+$Si_3N_4$-Based Mixed Powder Sintered Extruded Material]

(1) Powder Mixing Step

A pure Ti powder fabricated by the hydrogenation-dehydrogenation method and having an average particle size of 20 μm and silicon nitride particles ($Si_3N_4$) having an average particle size of 1 μm were prepared. To the pure Ti powder, 0.02 mass % of oil was added, and the oil was applied onto a Ti powder surface by mixing with a table ball mill for one hour. To the pure Ti powder having the oil applied thereon, $Si_3N_4$ particles were added within a range of 0.0 to 3.0 mass % (relative to the total mixed powder), followed by mixing with use of a rocking mill mixing apparatus under the conditions with a frequency of 60 Hz and a mixing time of one hour, thereby to fabricate a mixed powder.

(2) Vacuum Pressing Sintering Step and Homogenizing Heat Treatment Step

Pressurized vacuum sintering was carried out on the above mixed powder with use of a spark plasma sintering machine (SPS) under the conditions with a sintering temperature of 1273 K, holding time of 3.6 ks, an applied pressure of 30 MPa, and a vacuum degree of 6 Pa or less. On the sintered compact thus fabricated, a heat treatment was carried out in a vacuum electric furnace at 1273 K and 10.8 ks for the homogenizing treatment.

(3) Hot Extrusion Step

The temperature of the sintered compact subjected to the above heat treatment was raised with use of an infrared rapid heating furnace in an Ar gas atmosphere up to 1273 K at a heating rate of 2 K/s and, after the sintered compact was held at the temperature of 1273 K for 180 seconds, hot extrusion forming was immediately carried out with use of a hydraulically driven pressing machine, so as to fabricate an extruded rod material having a diameter ϕ of 15 mm. At that time, the extrusion ratio was set to be 6, and the extrusion speed was set to be 3 mm/s in terms of ram speed.

(4) Tensile Test

A tensile test was carried out on the above sintered extruded rod material in an ordinary-temperature ambient air atmosphere, so as to measure the tensile strength (MPa) and the elongation (%). The rate of strain was set to be $5\times10^{-4}$ $s^{-1}$. Further, with respect to each sample, the hardness (micro Vickers hardness), oxygen amount, and nitrogen amount were measured. The results are shown in Table 1.

TABLE 1

| Sintered extruded material | Yield strength YS (MPa) | Tensile strength UTS (MPa) | Elongation % | Hardness Hv | Oxygen amount mass % | Nitrogen amount mass % |
|---|---|---|---|---|---|---|
| Pure Ti | 438 | 579 | 26.5 | 221 | 0.32 | 0.04 |
| Ti + 0.5mass % $Si_3N_4$ | 830 | 912 | 26.0 | 299 | 0.33 | 0.31 |
| Ti + 1.0mass % $Si_3N_4$ | 1065 | 1139 | 12.6 | 392 | 0.35 | 0.57 |
| Ti + 1.5mass % $Si_3N_4$ | 1260 | 1265 | 0.0 | 431 | 0.31 | 0.84 |
| Ti + 2.0mass % $Si_3N_4$ | 0 | 549 | 0.5 | 515 | 0.30 | 1.12 |
| Ti + 3.0mass % $Si_3N_4$ | 2 | 360 | 0.0 | 564 | 0.30 | 1.60 |

From Table 1, the following will be understood.

First, with respect to the Ti+$Si_3N_4$ mixed powder sintered extruded material, when the amount of addition of $Si_3N_4$ particles increases, the hardness increases in proportion to this. Further, when the amount of addition of $Si_3N_4$ particles is smaller than or equal to 1.5 mass %, the yield strength and the tensile strength at an ordinary temperature increase according as the amount of addition increases. However, when the amount of addition of $Si_3N_4$ particles exceeds 1.5 mass %, the yield strength and the tensile strength rapidly decrease. Further, when the amount of addition of $Si_3N_4$ particles increases, the elongation decreases. Specifically, when the amount of addition of $Si_3N_4$ particles is 1.5 mass % or more, the elongation property considerably decreases.

When the sintered extruded material is used as a structural material, it is not regarded as a problem if the elongation value is 5% or more. It is believed that the elongation value of 10% or more is more preferable. From such a viewpoint, the Ti+1.0 mass % $Si_3N_4$-based sintered extruded material can be satisfactorily used as a structural material because of having an elongation value of 12.6%.

From the results of Table 1, it seems that the amount of addition of $Si_3N_4$ particles (relative to the total mixed powder) is preferably set to be about 0.1 mass % to 1.3 mass % in order to maintain the tensile strength, hardness, and elongation property at an ordinary temperature to be good.

The inventor of the present application further conducted a high-temperature tensile test at 400° C. on the Ti+$Si_3N_4$-based mixed powder sintered extruded material. The results are shown in Table 2 and FIG. 17.

TABLE 2

| Sintered extruded material | 0.2% Yield strength YS (MPa) | Tensile strength UTS (MPa) | Elongation % |
|---|---|---|---|
| Pure Ti | 85 | 157 | 14.3 |
| Ti + 1.0mass % $Si_3N_4$ | 285 | 424 | 24.6 |
| Ti + 2.0mass % $Si_3N_4$ | 450 | 572 | 19.1 |
| Ti + 3.0mass % $Si_3N_4$ | 566 | 656 | 10.8 |

Figure 17:
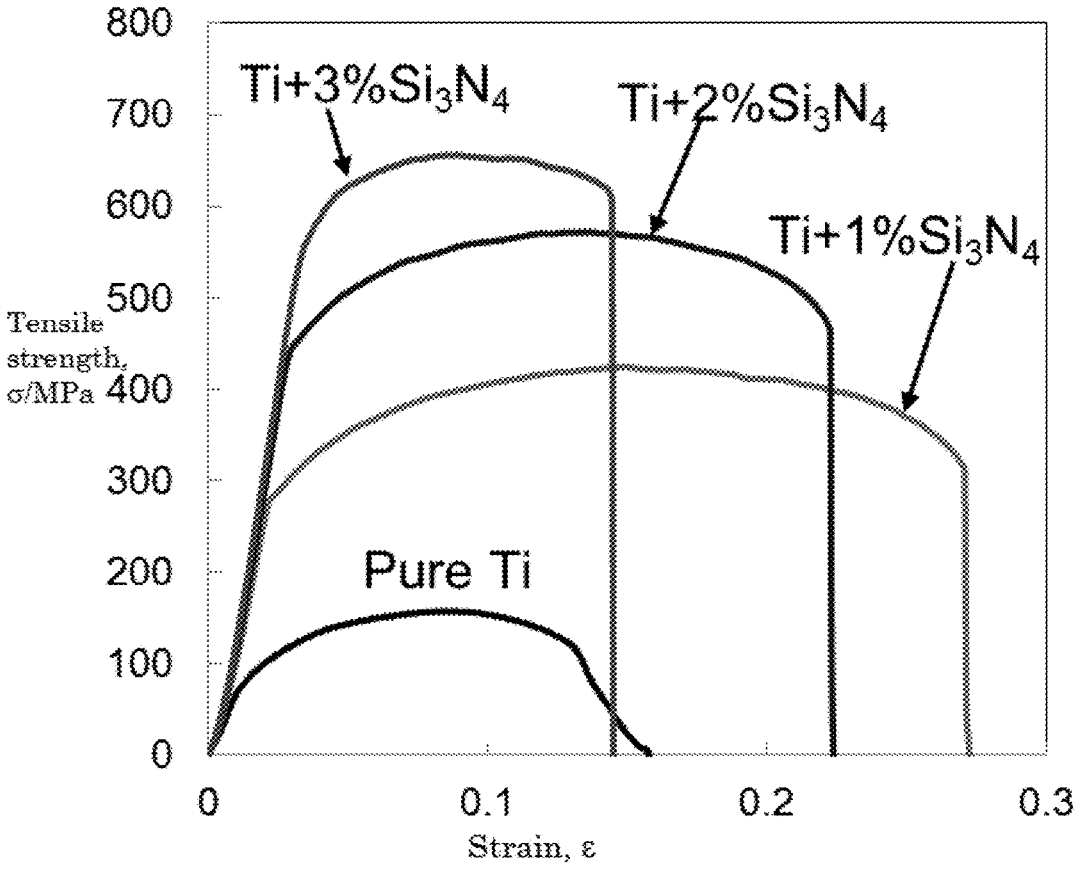
FIG. 17 is a stress-strain diagram of a Ti+$Si_3N_4$-based mixed powder sintered extruded material.

As will be clear from Table 2 and FIG. 17, the Ti+$Si_3N_4$ mixed powder sintered extruded material is excellent in the tensile strength at a high temperature, as compared with a sintered extruded material of pure Ti. In the tensile test at a high temperature, the elongation showed a value of 10.8% even when the amount of addition of $Si_3N_4$ particles was 3.0 mass %.

(5) Pin-On-Disk Abrasion Test

With respect to each of the samples of the pure titanium powder sintered extruded material, Ti+2 mass % $Si_3N_4$-based mixed powder sintered extruded material, and Ti+3 mass % $Si_3N_4$-based mixed powder sintered extruded material, a pin-on-disk abrasion test was carried out in an ambient air atmosphere. Specifically, a disk material was rotated in a state in which a pin made of the sintered extruded material was pressed onto the disk material, so as to confirm the abrasion wear state of the disk material and to measure the kinetic friction coefficient.

The measurement conditions are as follows.

Disk material: SKD61 steel (thermally treated material)

Load weight: 250 g

Sliding speed: 10 m/min. (rotation number of 191 rpm, rotation diameter of 10 mm)

Testing time: 60 min. (sliding distance: 600 m)

Figure 18:
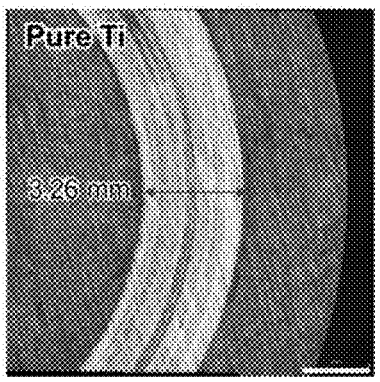
FIG. 18 is a micrograph showing an abrasion wear state of a disk material in a pin-on-disk type abrasion test.
Figure 18:
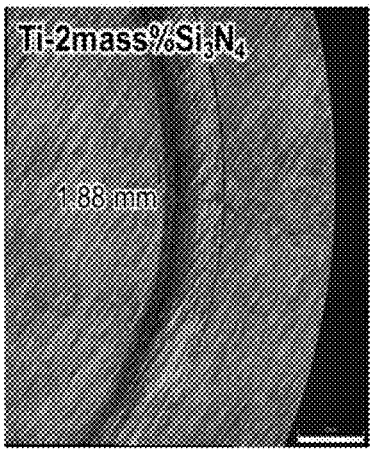
Figure 18:
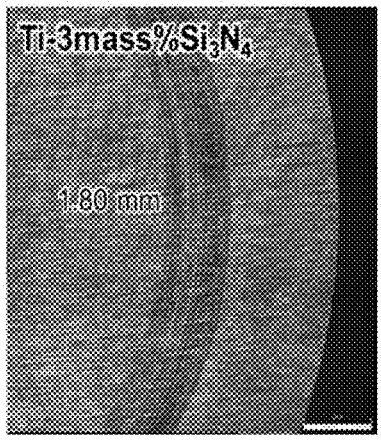

Evaluation items: abrasion wear state of disk material and transition of friction coefficient FIG. 18 is a micrograph showing the abrasion wear state of the disk material. The width of the slide scar and the mean roughness of the wear part were measured. The results are as follows.

In the case of the pure Ti powder sintered extruded material, the width of the slide scar was 3.26 mm, and the mean roughness Ra was 26.6 μm. In the case of the Ti+2 mass % $Si_3N_4$-based mixed powder sintered extruded material, the width of the slide scar was 1.88 mm, and the mean roughness Ra was 10.4 μm. In the case of the Ti+3 mass % $Si_3N_4$-based mixed powder sintered extruded material, the width of the slide scar was 1.80 mm, and the mean roughness Ra was 6.2 μm.

Figure 19:
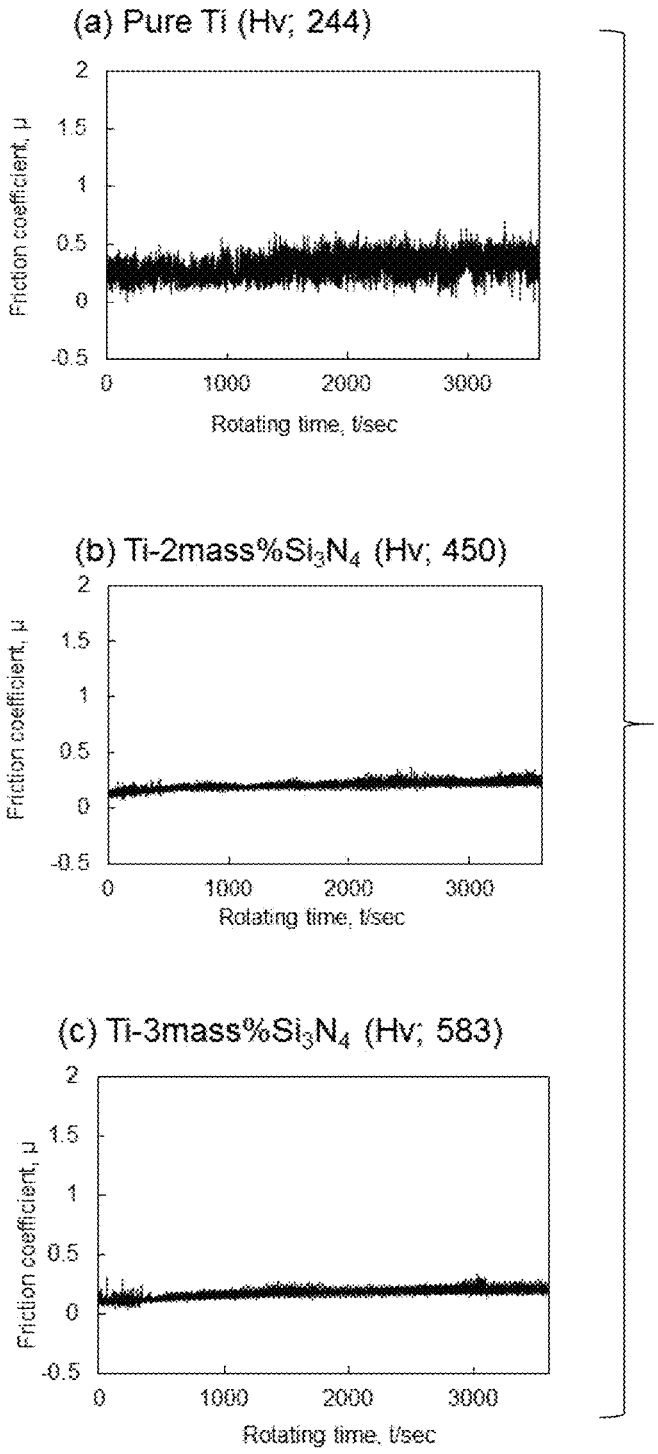
FIG. 19 is a graph showing transition of kinetic friction coefficient.

FIG. 19 is a graph showing transition of kinetic friction coefficient. In the case of the pure Ti powder sintered extruded material, the mean friction coefficient was 0.29. In the case of the Ti+2 mass % $Si_3N_4$-based mixed powder sintered extruded material, the mean friction coefficient was 0.20. In the case of the Ti+3 mass % $Si_3N_4$-based mixed powder sintered extruded material, the mean friction coefficient was 0.17.

From the results of the above abrasion test, it will be understood that, according as the amount of addition of $Si_3N_4$ increases, the hardness of the base texture of the Ti sintered extruded material increases, thereby improving the abrasion resistance.

[Strengthening Mechanism of Metal Atoms (Metal Component) Dissociated by Decomposition of Metal Nitride Particles]

When a titanium component powder made of a titanium component having an α phase and metal nitride particles are mixed and sintered, the metal nitride is decomposed, and the dissociated nitrogen atoms are dissolved as a solute of solid solution in the crystal lattice of titanium, and further the dissociated metal atoms are dissolved as a solute of solid solution in the crystal lattice of titanium, or are deposited in the matrix of titanium, or form a compound with titanium to be dispersed in the matrix of titanium. The strengthening mechanism of the metal atoms or the metal component may differ depending on the type of the metal constituting the metal nitride. The following Table 3 is an organized summary of the strengthening mechanism of the metal atoms or the metal component.

TABLE 3

| | M atom solid solution strengthening | Ti-M-based compound dispersion strengthening | M component deposition strengthening | Impartation of function to Ti by metal M |
|---|---|---|---|---|
| Ti + 5% AlN | ○ | ○ | | Improvement in hardness, abrasion resistance, and heat resistance |
| Ti + 5% $Si_3N_4$ | ○ | ○ | | Improvement in hardness, abrasion resistance, and heat resistance |
| Ti + 5% $Cr_2N$ | ○ | | | Improvement in hardness and heat resistance |

TABLE 3-continued

| | M atom solid solution strengthening | Ti-M-based compound dispersion strengthening | M component deposition strengthening | Impartation of function to Ti by metal M |
|---|---|---|---|---|
| Ti + 5% VN | ○ | ○ | | Improvement in hardness, abrasion resistance, and heat resistance, impartation of bioaffinity |
| Ti + 5% $Mo_2N$ | | ○ | | Improvement in hardness, abrasion resistance, and heat resistance, impartation of bioaffinity |
| Ti + 5% TaN | ○ | | | Improvement in ductility, impartation of bioaffinity |
| Ti + 5% ZrN | ○ | | | Improvement in ductility, impartation of bioaffinity |

In Table 3, in the case of the Ti+5% AlN sintered compact extruded material, the aluminum atoms are dissolved as a solute of solid solution into the crystal lattice of Ti, and part of the aluminum atoms react with Ti to form a Ti—Al-based compound to be dispersed in the matrix of Ti. The strengthening mechanism to titanium is solid solution strengthening of the nitrogen atoms, solid solution strengthening of the aluminum atoms, and dispersion strengthening of the Ti—Al-based compound. This strengthening mechanism improves the hardness, abrasion resistance, and heat resistance of the titanium component material.

In the case of the Ti+5% $Cr_2N$ sintered extruded material, the chromium atoms are dissolved as a solute of solid solution into the crystal lattice of titanium. The strengthening mechanism to titanium is solid solution strengthening of the nitrogen atoms and solid solution strengthening of the chromium atoms, and this strengthening mechanism improves the hardness and heat resistance of the titanium component material.

In the case of the Ti+5% TaN sintered compact extruded material, the tantalum atoms are dissolved as a solute of solid solution into the crystal lattice of Ti. The strengthening mechanism to titanium is solid solution strengthening of the nitrogen atoms and solid solution strengthening of the tantalum atoms, and this strengthening mechanism improves the ductility of the titanium component material and imparts a bioaffinity.

INDUSTRIAL APPLICABILITY

The nitrogen solid solution titanium sintered compact and the method for producing the same according to the present invention can be advantageously used in obtaining a high-strength titanium material.

The invention claimed is:

1. A nitrogen solid solution titanium sintered compact comprising:

a matrix made of a titanium component having an α-phase;

nitrogen atoms dissolved as a solute of solid solution in a crystal lattice of a hexagonal close-packed structure of said titanium component; and metal atoms dissolved as a solute of solid solution in the crystal lattice of a hexagonal close-packed structure of said titanium component, wherein an amount of said nitrogen in the solid solution titanium sintered compact ranges from 0.31 to 0.84 mass %, a yield strength of the solid solution titanium sintered compact is greater than a yield strength of a pure titanium-based sintered compact at room temperature, a tensile strength of the solid solution titanium sintered compact is greater than a tensile strength of the pure titanium-based sintered compact at room temperature, a hardness of the solid solution titanium sintered compact is greater than a hardness of the pure titanium-based sintered compact at room temperature, and an elongation percentage of the solid solution titanium sintered compact is greater than an elongation percentage of the pure titanium-based sintered compact and is not less than 19.1% at a temperature of 400° C.

2. The nitrogen solid solution titanium sintered compact according to claim 1, wherein a compound of said titanium component and said metal atoms exceeding a solid solubility limit of dissolving into the α-phase is dispersed in said matrix.

3. The nitrogen solid solution titanium sintered compact according to claim 1, wherein a metal of said metal atoms is a metal selected from the group consisting of Al, Si, Cr, V, Mo, Ta, and Zr.

4. The nitrogen solid solution titanium sintered compact according to claim 1, wherein the metal atoms are dissolved as the solute of the solid solution by heating a mixture of first powder comprising a titanium component powder made of a titanium component and a second powder comprising nitride particles of a metal other than titanium, and an amount of said metal nitride particles is within a range of 0.1% to 7% in terms of mass with respect to the total mixture of the first powder and the second powder.

5. The nitrogen solid solution titanium sintered compact according to claim 4, wherein the amount of said metal nitride particles is in a range of 0.5% to 1.5% in terms of mass with respect to the total mixture of the first powder and the second powder.

6. The nitrogen solid solution titanium sintered compact according to claim 4, wherein said metal nitride particles comprise silicon nitride particles and the amount of silicon nitride particles is in a range of 0.5% to 1.5% in terms of mass with respect to the total mixture of the first powder and the second powder.

7. A nitrogen solid solution titanium material sintered compact comprising:

a matrix made of a titanium component having an α-phase;

nitrogen atoms dissolved as a solute of solid solution in a crystal lattice of a hexagonal close-packed structure of said titanium component; and a metal component that is present by being dispersed in said matrix, wherein an amount of said nitrogen in the solid solution titanium sintered compact ranges from 0.31 to 0.84 mass %, a yield strength of the solid solution titanium sintered compact is greater than a yield strength of a pure titanium-based sintered compact at room temperature, a tensile strength of the solid solution titanium sintered compact is greater than a tensile strength of the pure titanium-based sintered compact at room temperature, a hardness of the solid solution titanium sintered compact is greater than a hardness of the pure titanium-based sintered compact at room temperature, and an elongation percentage of the solid solution titanium sintered compact is greater than an elongation percentage of the pure titanium-based sintered compact and is not less than 19.1% at a temperature of 400° C.

8. The nitrogen solid solution titanium sintered compact according to claim 7, wherein said metal component is made of metal atoms that are deposited in said matrix.

9. The nitrogen solid solution titanium sintered compact according to claim 7, wherein said metal component is a compound of metal atoms and said titanium component.

10. The nitrogen solid solution titanium sintered compact according to claim 7, wherein a metal of said metal component is a metal selected from the group consisting of Al, Si, Cr, V, Mo, Ta, and Zr.

11. The nitrogen solid solution titanium sintered compact according to claim 7, wherein atoms of the metal component are dissolved as the solute of the solid solution by heating a mixture of first powder comprising a titanium component powder made of a titanium component and a second powder comprising nitride particles of a metal other than titanium, and an amount of said metal nitride particles is within a range of 0.1% to 7% in terms of mass with respect to the total mixture of the first powder and the second powder.

12. The nitrogen solid solution titanium sintered compact according to claim 11, wherein the amount of said metal nitride particles is in a range of 0.5% to 1.5% in terms of mass with respect to the total mixture of the first powder and the second powder.

13. The nitrogen solid solution titanium sintered compact according to claim 11, wherein said metal nitride particles comprise silicon nitride particles and the amount of silicon nitride particles is in a range of 0.5% to 1.5% in terms of mass with respect to the total mixture of the first powder and the second powder.

* * * * *